US006179174B1

(12) United States Patent
Kandl

(10) Patent No.: US 6,179,174 B1
(45) Date of Patent: Jan. 30, 2001

(54) ADJUSTABLE HANGER

(76) Inventor: Laura L. Kandl, 1340 Bunker Ave., Flossmoor, IL (US) 60422-1830

( * ) Notice: Under 35 U.S.C. 154(b), the term of this patent shall be extended for 0 days.

(21) Appl. No.: 09/411,565

(22) Filed: Oct. 4, 1999

(51) Int. Cl.[7] ..... A47G 25/40
(52) U.S. Cl. ..... 223/94; 223/89
(58) Field of Search ..... 223/89, 94, 85, 223/88, 92

(56) References Cited

U.S. PATENT DOCUMENTS

| | | | | |
|---|---|---|---|---|
| D. 157,089 | * | 1/1950 | Saunders | 223/94 |
| 2,360,119 | | 10/1944 | Gallagher . | |
| 2,491,836 | | 12/1949 | Simmet . | |
| 2,738,908 | | 3/1956 | White . | |
| 4,004,721 | * | 1/1977 | Ross | 223/94 |
| 4,334,641 | | 6/1982 | Narcum . | |
| 4,905,877 | | 3/1990 | Gatling . | |
| 5,007,562 | | 4/1991 | Brink et al. . | |
| 5,052,599 | | 10/1991 | Platti . | |
| 5,476,199 | | 12/1995 | Halverson et al. . | |
| 5,598,957 | | 2/1997 | Bell . | |
| 5,718,358 | * | 2/1998 | Long et al. | 223/94 |

* cited by examiner

*Primary Examiner*—Bibhu Mohanty
(74) *Attorney, Agent, or Firm*—Sonnenschein Nath & Rosenthal

(57) ABSTRACT

An adjustable hanger is provided having a V-shaped hanging member and two V-shaped connectors, the V-shaped hanging member having a hook portion attached to two shaft members. Optionally, the hook portion may be pivotally attached to the two shaft members via a swivel. The V-shaped connectors are slidably engageable with the V-shaped hanging member and each other providing the user with an easy to use hanger that can be adjusted from eighteen inches to twenty-eight inches accommodating numerous different sizes of clothes.

14 Claims, 4 Drawing Sheets

ADJUSTABLE HANGER

Background of the Invention

A. Field of the Invention

The present invention relates generally to hangers and in particular to an adjustable hanger for accommodating various sizes of clothes, from those having narrow shoulder separation to those having a wide separation. The adjustable hanger dimensions can be increased or decreased depending on the size of the clothing to be supported by the hanger.

B. Prior Art

Currently, there exist hangers to fit various size clothing to allow a person to store their clothes efficiently and without the necessity of folding. There does not exist, however, a hanger to accommodate larger sized adult clothes or a hanger to accommodate varying smaller sized clothes as those for infants, toddlers and older children. Traditional clothing sizes for larger adult clothes range from size thirty-two (32), having a width of sixteen inches (16") to size seventy (70), having a width of thirty-five inches (35"). A standard hanger is seventeen inches (17") wide and accommodates adult clothing sizes thirty-two (32) and smaller. While some larger sized hangers exist for sizes thirty-four (34) to fifty-two (52) , there are currently no hangers for adult clothing sizes fifty-four (54) and above. One problem encountered with using an inappropriately sized hanger with larger adult sizes is that the clothes are difficult to hang and frequently fall off the hanger because of the larger neck opening. In a retail clothes store this is especially bothersome because the larger sized clothes get dirty, wrinkled and are even stepped upon once they fall on the ground.

Another problem is that the ends of the hanger cause deformities in the fabric of the clothes being hung. Once a deformity appears, it is hard to remove and this may leave the clothing unwearable. Therefore, there is a need in the art for a hanger to accommodate larger sized adult clothing.

Accordingly, adjustable hangers have been introduced. Presently, however, adjustable hangers are complex devices. While there are several varieties of adjustable hangers known to those skilled in the art, none are simple, easy to use devices.

One form of adjustable hanger provides an extension capability in the form of extending elements attached to a one piece hanger. The extending elements are generally U-shaped and are under tension. Such a configuration is not desirable because the user has difficulty adjusting the elements under tension.

Another form of an adjustable hanger provides U-shaped members having ends with lips, the ends being receivable within apertures contained in upper and lower tubular rods. This type of hanger is not desirable because the user cannot easily adjust the size of the hanger. The projecting lips need to be removed from one aperture and reinserted into another aperture for the hanger to increase or decrease in size. Also, the number of adjustment positions for lengthening or shortening the hanger is limited to the number of apertures found on the rods.

Yet another type of adjustable hanger provides a structure having a gear on the lower end of the hook meshing with teeth within two telescoping members. The hook is turned to rotate a gear which increases or decreases the size of the hanger. This type of adjustable hanger is disadvantageous because it has many parts that could break and disable the adjustability feature. Additionally, the number and complexity of the parts make this type of adjustable hanger expensive and difficult to manufacture.

Finally, another type of adjustable hanger provides a structure with tubular adjustable shoulders for individual or multiple rods. Such shoulders are disadvantageous because they may be easily disconnected from the hanger during hanging or removal of garments.

SUMMARY OF THE INVENTION

An adjustable hanger is provided having a V-shaped hanging member and two V-shaped connectors, the V-shaped hanging member having a hook portion attached to two shaft members. The V-shaped connectors are slidably engageable with the V-shaped hanging member and with each other, providing the user with an easy to use hanger that can be adjusted to numerous different sizes to accommodate various sized clothing.

Accordingly, it is an object of the present invention to provide an adjustable hanger that has an unlimited number of positions, whereby the hanger can be adjusted to accommodate various sized clothing.

It is another object of the present invention to provide an adjustable hanger that is easily adjustable.

It is yet another object of the present invention to provide an adjustable hanger with a limited number of parts making it easy to use and manufacture.

DESCRIPTION OF THE PREFERED EMBODIMENTS

Figure 1:
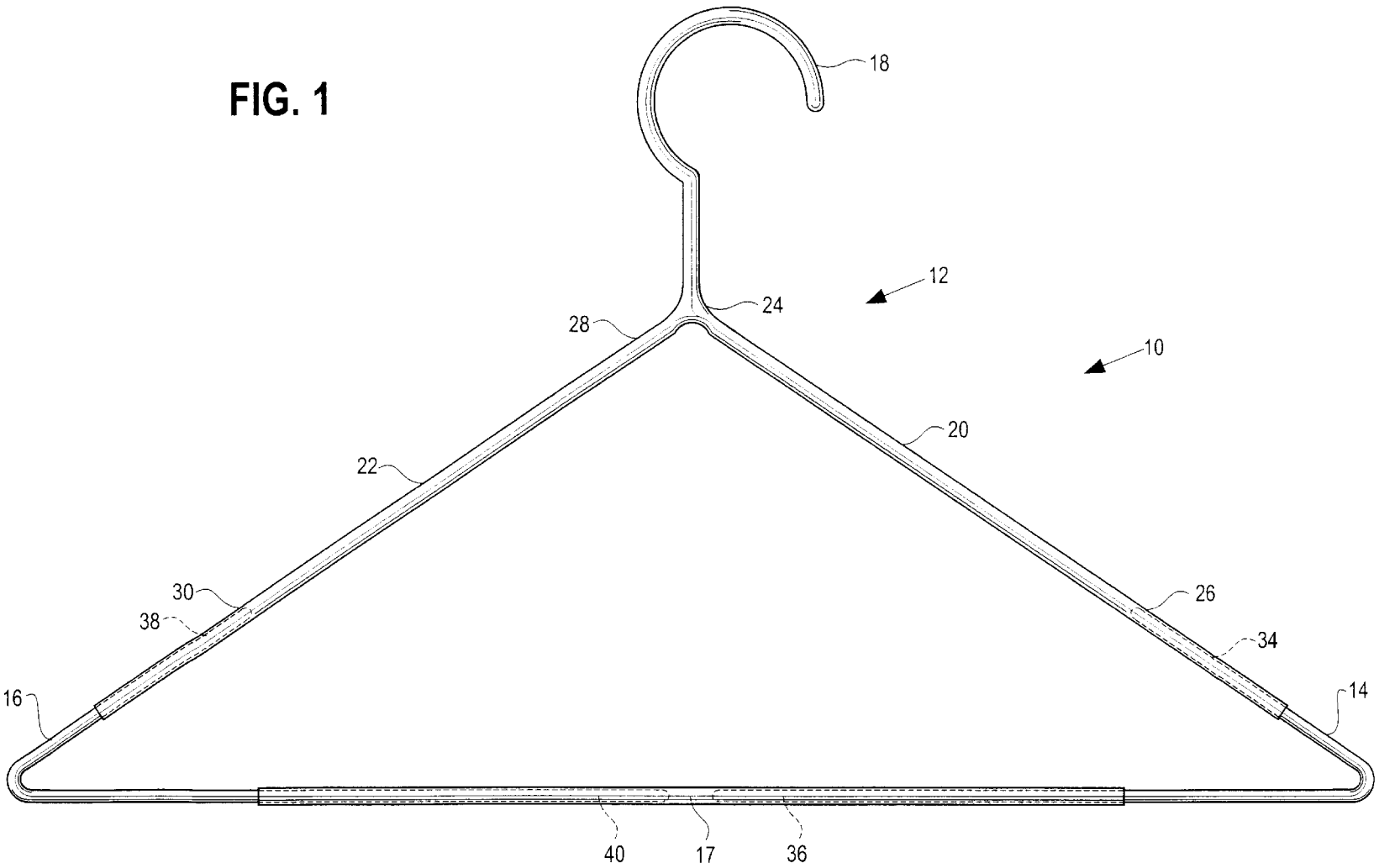
FIG. 1 is a front perspective view of the adjustable hanger of the present invention.
Figure 2:
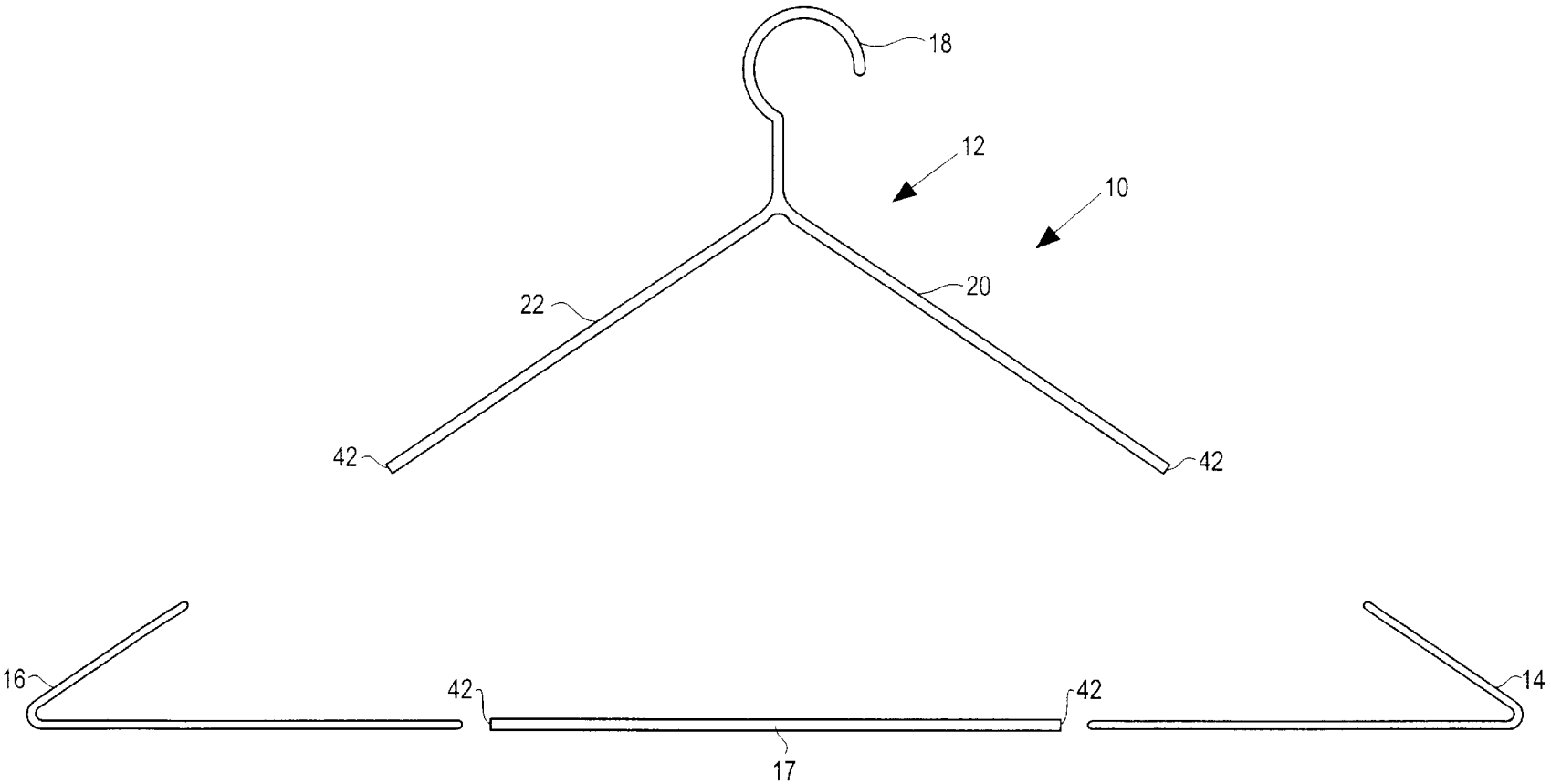
FIG. 2 is an exploded front perspective view of the adjustable hanger of FIG. 1.

As shown in FIGS. 1 and 2, the adjustable hanger 10 comprises a V-shaped hanging member 12 slidably engageable with first and second V-shaped connectors 14, 16. First V-shaped connector 14 is slidably engageable with second V-shaped connector 16 via an intermediately disposed engagement tube 17 to form the bottom of the adjustable hanger 10. In an alternate embodiment, shown in FIG. 3, first and second V-shaped connectors 14, 16 are slidably engageable with each other without employing an engagement tube 17.

As shown in FIGS. 1 and 2, the V-shaped hanging member 12 includes a hook portion 18, and first and second shaft members 20, 22. Hook portion 18 is provided for hanging the adjustable hanger 10 on a rod or protuberance, such as are normally found in closets. First and second shaft members 20, 22 each have upper and lower ends 24, 26, 28, 30. Upper ends 24, 28 of first and second shaft members 20, 22 extend from the lower ends of hook portion 18. Optionally, a swivel (not shown) may be provided, pivotally connecting hook portion 18 to first and second shaft members 20, 22.

As shown in FIGS. 1 and 2, first and second shaft members 20, 22 in one embodiment, comprise hollow tubular structures that are open at their lower ends 26, 30. First and second shaft members 20, 22 of the V-shaped hanging member 12 are of sufficient internal diameter to frictionally slidably receive the solid V-shaped connectors 14, 16. Alternatively, it is understood by those skilled in the art that the lower ends 26, 30 of first and second shaft members 20, 22 could be solid and of a sufficient diameter to the extent necessary for frictionally slidably fitting within V-shaped connectors 14, 16 that were hollow rather than solid. It is contemplated that other means for slidably engaging V-shaped connectors 14, 16 may be employed in addition to varying the shape or size of the shaft members 20, 22 of the V-shaped hanging member 12 or the V-shaped connectors 14, 16.

As shown in FIGS. 1 and 2, first and second V-shaped connectors 14, 16 each have a first and second end 34, 36, 38, 40, the first ends 34, 38 being frictionally slidably engageable within the open lower ends 26, 30 of the first and second shaft members 20, 22 of the V-shaped hanging member 12. The second ends 36, 40 of the V-shaped connectors 14, 16 are slidably engageable within the engagement tube 17. In the preferred embodiment V-shaped connectors 14, 16 are solid tubular structures that frictionally fit within the hollow lower ends 26, 30 of the shaft members 20, 22 of the V-shaped hanging member 12. In the illustrated embodiment, engagement tube 17 is provided to slidably engage the second ends 36, 40 of the V-shaped connectors 14, 16. The engagement tube 17 is also a hollow tubular structure, wherein one end of the engagement tube 17 frictionally receives the second end 36 of the first V-shaped connector 14 while the opposite end of the engagement tube 17 frictionally receives the second end 40 of the second V-shaped connector 16. As shown in FIG. 2, in the preferred embodiment, open lower ends 26, 30 of the first and second shaft members 20, 22 of the V-shaped hanging member 12, and each end of the engagement tube 17, contain a rubber washer 42 to maintain friction between the V-shaped hanging member 12, the V-shaped connectors 14, 16 and the engagement tube 17. While the rubber washers are preferred, it is understood by those skilled in the art, that the rubber washers are not necessary for the operation of the invention. Alternatively, V-shaped connectors 14, 16 and engagement tube 17 may be slightly crimped to hold their respective portions during the operation of the adjustable hanger.

The adjustable hanger 10 is preferably made of metal, heavy durable plastic, lightweight aluminum hollow tubing or other like material resistant to excessive bending or breaking when clothes are suspended from the adjustable hanger 10. The adjustable hanger 10 is preferably made of sufficient width such that the first and second V-shaped connectors 14, 16 extend over a distance of eighteen inches (18") from a fully inward position to a fully extended position for larger sized adult clothing. In an alternative embodiment, adjustable hanger 10 is preferably made of sufficient width such that the first and second V-shaped connectors 14, 16 extend over a distance of eight inches (8") from a fully inward or closed position, for infant or children sized clothing, to a fully extended position of seventeen and one-half inches (17.5"), for adult sized clothing.

In one embodiment, as shown in FIG. 2, a one-piece construction of V-shaped hanging member 12 is contemplated, wherein upper end 24 of first shaft member 20 is joined to upper end 28 of second shaft member 22. Hook portion 18 extends from the upper ends 24, 28 of first and second shaft members 20, 22. Optionally, a swivel element (not shown) may be provided, pivotally connecting hook portion 18 to shaft members 20, 22. While the swivel element is preferred, it is not necessary to the operation of the invention. The swivel element enables a user to properly close a closet door that otherwise would not have closed due to the size of the hanger. In order to take advantage of this feature, the user hangs the larger sized adult clothes on the adjustable hanger 10 and then moves the hanger about the pivot so the adjustable hanger 10 can hang at an angle, allowing the user to close the closet door. The pivot would not be necessary where the adjustable hanger 10 is used on a freestanding rack, as in a retail clothing store display.

Figure 3:
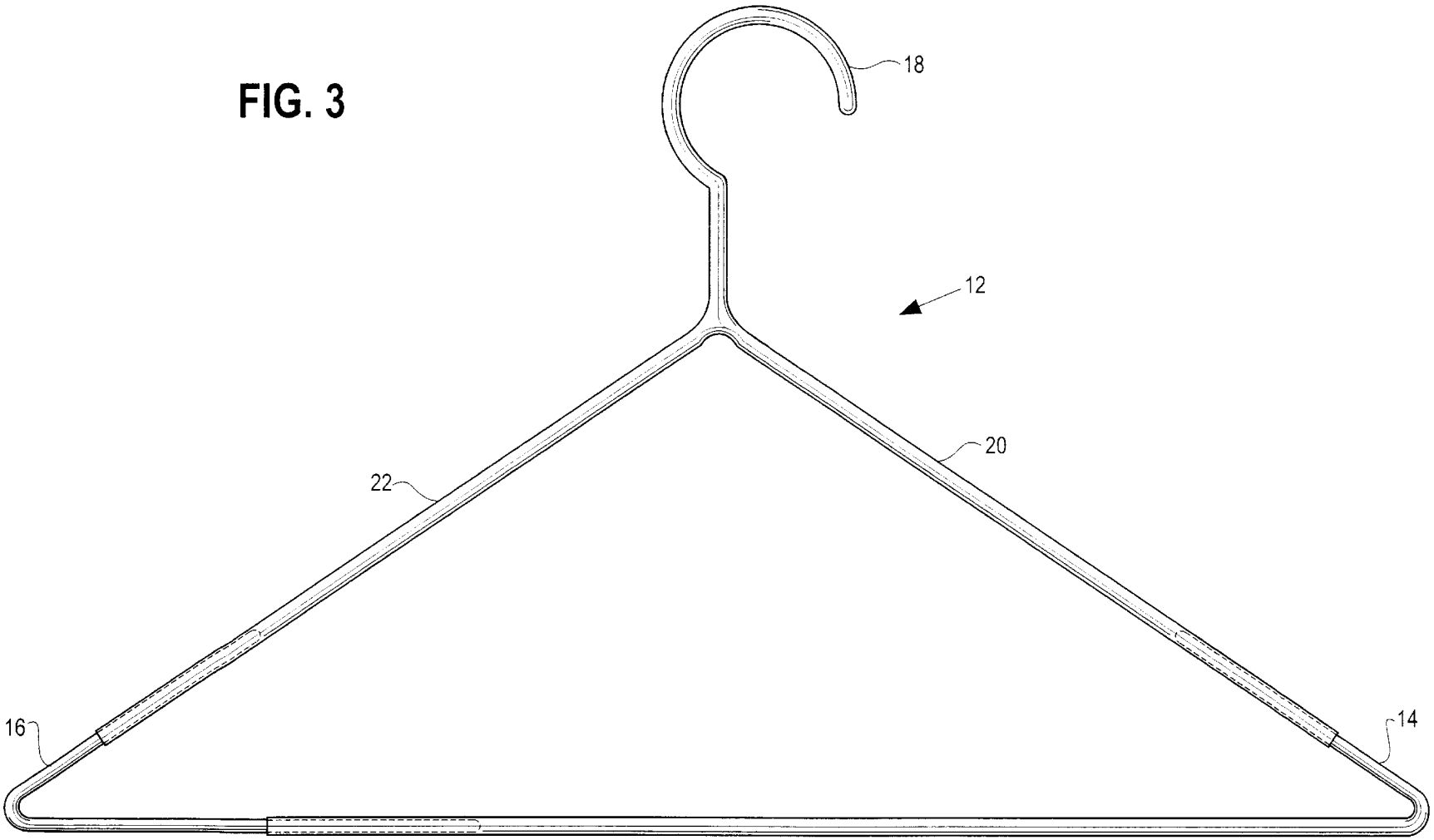
FIG. 3 is a front perspective view of a three piece embodiment of the adjustable hanger.

In an alternative embodiment, as illustrated in FIG. 3, engagement tube 17 is eliminated. The second ends 36, 40 of the V-shaped connectors 14, 16 are constructed such that the second end 36 of the first V-shaped connector 14 is hollow and of sufficient circumference for frictionally receiving the second end 40 of the second V-shaped connector 16.

Figure 4A:
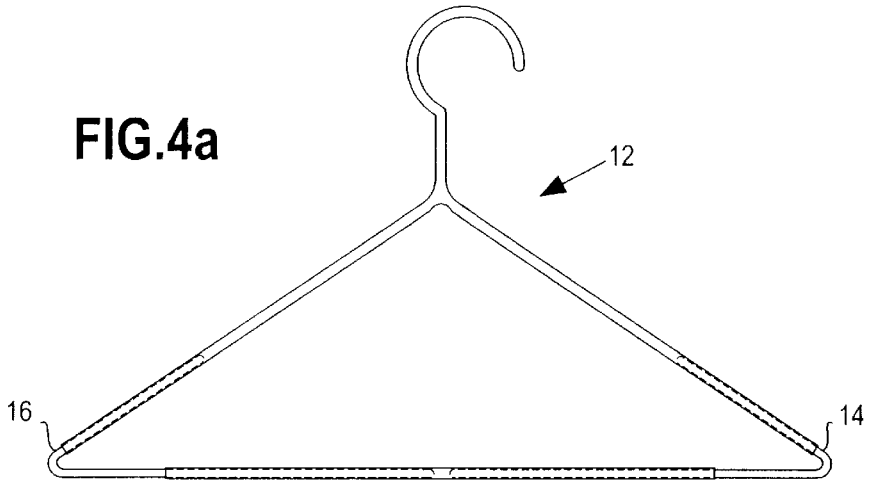
FIG. 4*a* is a front perspective view of the adjustable hanger of FIG. 1 in its initial position.
Figure 4B:
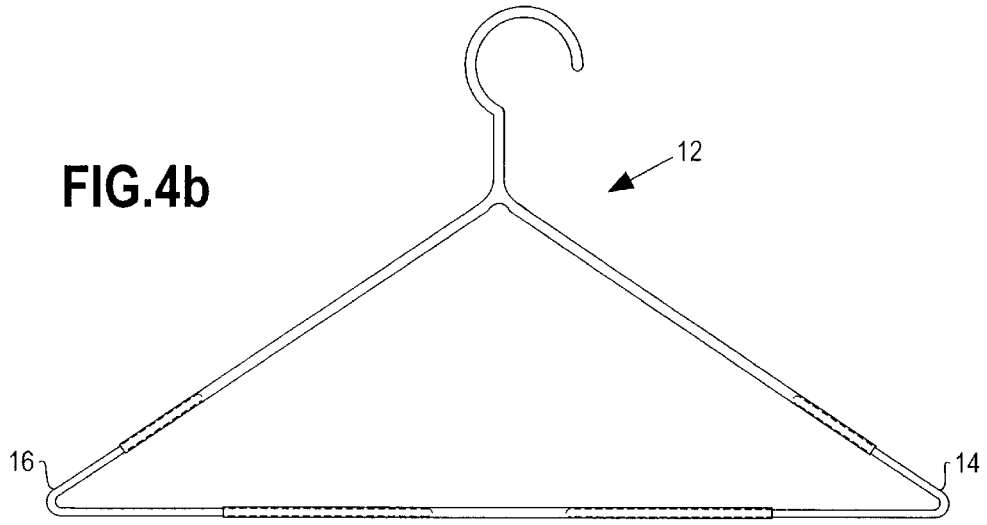
FIG. 4*b* is a front perspective view of the adjustable hanger of FIG. 1 extended to the middle length position.
Figure 4C:
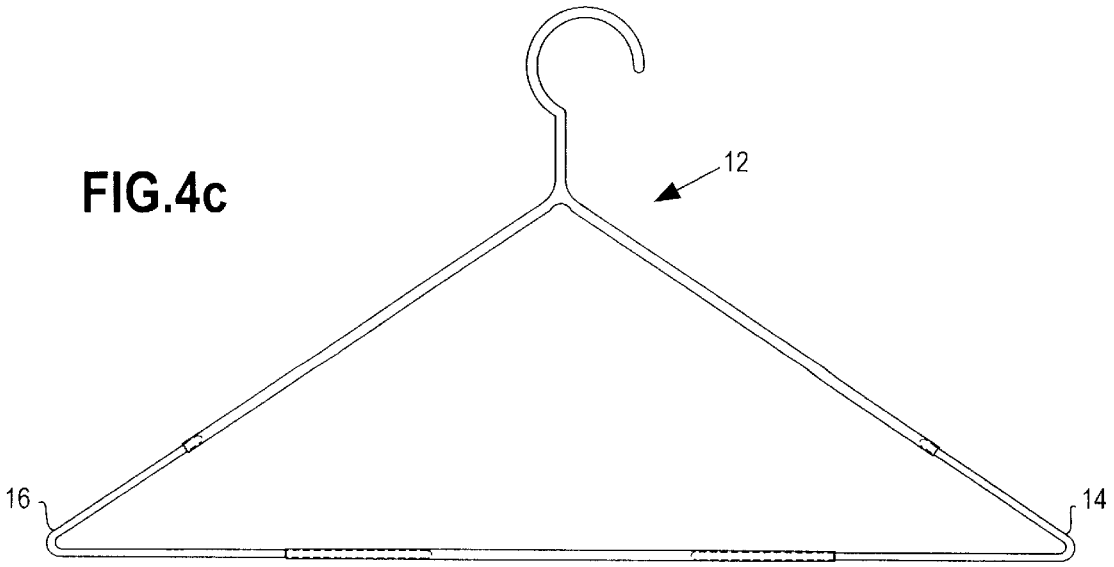
FIG. 4*c* is front perspective view of the adjustable hanger of FIG. 1 extended to the maximum length position.

FIGS. 4*a*, 4*b* and 4*c* show three possible stages of operation of the inventive adjustable hanger 10. In FIG. 4*a*, the adjustable hanger 10 is in its initial position. The V-shaped connectors 14, 16 are not extended, providing a clothes hanger for smaller or regular sized clothes. To adjust the inventive hanger, the user simply simuntaneously pulls outward on both V-shaped connectors 14, 16 and expands the hanger to the desired width. Similarly, to shorten the hanger, the user simply pushes inward on the V-shaped connectors 14, 16. In FIG. 4*b*, the V-shaped connectors 14, 16 are extended to the middle length position, providing a hanger for larger sized clothes. In FIG. 4*c*, the V-shaped connectors 14, 16 are extended to their maximum length position, providing a hanger for the largest sized clothes. It is understood by those skilled in the art that the V-shaped connectors 14, 16 may be extended in an infinite number of increments between the initial, middle and fully extended positions allowing the user to create a hanger appropriate for the particular article of clothing. Once an article of clothing is appropriately hung on hanger 12, hook 18 is extended over a suitable closet rod or hook (not shown) to support the hanger 12 and the article of clothing.

The foregoing description of the embodiments of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and modifications as are suited to the particular use contemplated. It is intended that the scope of the invention not be limited by the specification, but be defined by the claims set forth below.

I claim:

1. An adjustable hanger, comprising:

a V-shaped hanging member having a hook portion, and first and second shaft portions each having upper and lower ends, wherein the upper ends of the first and second shaft portions extend from a lower end of the hook portion;

a first V-shaped connector, having first and second ends, the first end of said first V-shaped connector being slidably and frictionally engageable with the second end of the first shaft portion of said V-shaped hanging member, said first V-shaped connector being maintained in a first position relative to said second end of the first shaft portion by said friction engagement until said first V-shaped connector is moved to a second position by manually overcoming said friction engagement between said first end of said V-shaped connector and said second end of the first shaft portion of said V-shaped hanging member;

a second V-shaped connector, having first and second ends, the first end of said second V-shaped connector being slidably and frictionally engageable with the second end of the second shaft portion of said V-shaped hanging member, said second V-shaped connector being maintained in a first position relative to said second end of the second shaft portion by said friction engagement until said second V-shaped connector is moved to a second position by manually overcoming said friction engagement between said first end of said second V-shaped connector and the second end of said second shaft portion of said V-shaped hanging member; and an engagement tube slidably and frictionally engaging the second ends of said first and second V-shaped connectors.

2. An adjustable hanger as recited in claim 1, wherein the first ends of said V-shaped connectors are frictionally engageable within hollow portions of said V-shaped hanging member, and the second ends of said V-shaped connectors are frictionally engageable within hollow portions of said engagement tube.

3. An adjustable hanger as recited in claim 1, wherein said first and second V-shaped connectors are adapted to slide relative to said V-shaped hanging member and relative to said engagement tube from said respective first positions to said respective second positions.

4. An adjustable hanger as recited in claim 3, wherein the first and second V-shaped connectors extend over a distance of ten inches from said fully inward position to said fully extended position.

5. An adjustable hanger as recited in claim 3, wherein the first and second V-shaped connectors extend over a distance of eight inches from said fully inward position to said fully extended position.

6. An adjustable hanger as recited in claim 1, wherein said V-shaped hanging member and each of said V-shaped connectors is made of heavy durable plastic.

7. An adjustable hanger as recited in claim 1, wherein said V-shaped hanging member and each of said V-shaped connectors is made of lightweight hollow aluminum tubing.

8. An adjustable hanger, comprising:

a V-shaped hanging member having a hook portion, and first and second shaft portions each having upper and lower ends, wherein the upper ends of the first and second shaft portions extend from a lower end of the hook portion;

a first V-shaped connector, having first and second ends, the first end of said first V-shaped connector being slidably and frictionally engageable with the second end of the first shaft portion of said V-shaped hanging member, said first V-shaped connector being maintained in a first position relative to said second end of the first shaft portion by said friction engagement until said first V-shaped connector is moved to a second position by manually overcoming said friction engagement between said first end of said V-shaped connector and said second end of the first shaft portion of said V-shaped hanging member; and a second V-shaped connector, having first and second ends, the first end of said second V-shaped connector being slidably and frictionally engageable with the second end of the second shaft portion of said V-shaped hanging member, and the second end of said second V-shaped connector being slidably and frictionally engageable with the second end of said first V-shaped connector, said first and second V-shaped connectors being maintained in a first position relative to each other and to said first and second ends of said V-shaped hanging member, respectively, by said friction engaszement until said first and second V-shaped connectors are moved to a second position by manually overcoming said friction engagement between said first end of said first V-shaped connector and the second end of the first shaft portion of said V-shaped hanging member, and overcoming said friction engagement between said second end of said second V-shaped connector and the second end of said first V-shaped connector.

9. An adjustable hanger as recited in claim 8, wherein the first ends of said V-shaped connectors are frictionally engageable within a hollow portion of said V-shaped hanging member, and the second end of said first V-shaped connector is frictionally engageable within a hollow portion of the second end of said second V-shaped connector.

10. An adjustable hanger as recited in claim 8, wherein said first and second V-shaped connectors are adapted to frictionally slide relative to said V-shaped hanging member and relative to each other between said first and second position.

11. An adjustable hanger as recited in claim 10, wherein the first and second V-shaped connectors extend over a distance of ten inches from a fully inward position to a fully extended position.

12. An adjustable hanger as recited in claim 8, wherein said V-shaped member and each of said V-shaped connectors are made of heavy durable plastic.

13. An adjustable hanger as recited in claim 8, wherein said V-shaped member and each of said V-shaped connectors are made of lightweight hollow aluminum tubing.

14. The adjustable hanger of claim 8 including an engagement tube frictionally engaging the second ends of said first and second V-shaped connectors.

* * * * *